US012145019B2

(12) United States Patent
Mäkelä et al.

(10) Patent No.: US 12,145,019 B2
(45) Date of Patent: Nov. 19, 2024

(54) WORKOUT EQUIPMENT

(71) Applicant: Lappset Group Oy, Rovaniemi (FI)

(72) Inventors: Mari Mäkelä, Jääli (FI); Kalle Suorsa, Liminka (FI); Aarni Mertala, Turku (FI); Matti Posti, Rovaniemi (FI)

(73) Assignee: LAPPSET GROUP OY, Rovaniemi (FI)

( * ) Notice: Subject to any disclaimer, the term of this patent is extended or adjusted under 35 U.S.C. 154(b) by 38 days.

(21) Appl. No.: 17/511,971

(22) Filed: Oct. 27, 2021

(65) Prior Publication Data

US 2022/0134168 A1 May 5, 2022

(30) Foreign Application Priority Data

Oct. 30, 2020 (EP) ..... 20204840

(51) Int. Cl.
*A63B 21/06* (2006.01)
*A63B 21/00* (2006.01)

(52) U.S. Cl.
CPC .... *A63B 21/0616* (2015.10); *A63B 21/00072* (2013.01)

(58) Field of Classification Search
CPC ..... A63B 21/0616; A63B 21/00072
See application file for complete search history.

(56) References Cited

U.S. PATENT DOCUMENTS 3,364,747 A 1/1968 Ebstein
3,647,209 A * 3/1972 La Lanne ..... A63B 21/063 235/93
5,102,122 A * 4/1992 Piane, Jr. ..... A63B 21/156 482/133

(Continued)

FOREIGN PATENT DOCUMENTS

DE 4419883 A1 1/1996
EP 0643983 A1 9/1994
EP 1423170 B1 1/2007

(Continued)

OTHER PUBLICATIONS

Extended European Search Report for EP Application No. 20204840.1 mailed Jul. 28, 2021 (12 pages).

(Continued)

*Primary Examiner* — Sundhara M Ganesan
*Assistant Examiner* — Jacqueline N L Loberiza
(74) *Attorney, Agent, or Firm* — Merchant & Gould P.C.

(57) ABSTRACT

Workout equipment includes a frame and a movable arm pivotally connected to the frame, the movable arm having a first end and a second end. A movable load unit is supported by the movable arm and a load transferer is configured to move the load unit along the movable arm. The movable arm includes a first guide and a second guide, the load unit is supported by the first and second guides and the load transferer includes a locking device for locking the load unit on the first and second guides. The load transferer includes a threaded rod having a first end and a second end, the threaded rod being parallel to the first and second guides. The load unit has a threaded aperture through which the threaded rod projects and the load unit includes weight plates connected together, each weight plate having a hole creating the aperture.

10 Claims, 3 Drawing Sheets

(56) References Cited

U.S. PATENT DOCUMENTS 5,688,216 A * 11/1997 Mauriello ..... A63B 21/154
482/142

FOREIGN PATENT DOCUMENTS

| | | | | |
|---|---|---|---|---|
| EP | 3434338 | A1 | | 1/2019 |
| EP | 3344348 | B1 | | 4/2020 |
| FR | 2767707 | A1 | | 3/1999 |
| FR | 2881355 | A1 | | 8/2006 |
| WO | 2017/040743 | A1 | | 3/2017 |
| WO | WO2022081117 | | * | 4/2022 |
| WO | WO-2022081117 | A1 | * | 4/2022 |

OTHER PUBLICATIONS

European Office Action for EP Application No. 20204840.1 mailed Nov. 10, 2021 (6 pages).

* cited by examiner

WORKOUT EQUIPMENT

CROSS-REFERENCE TO RELATED APPLICATION

This application claims benefit of European Application No. 20204840.1, filed 30 Oct. 2020, and which application is incorporated herein by reference. To the extent appropriate, a claim of priority is made to the above-disclosed application.

TECHNICAL FIELD

A workout equipment comprising a frame, a movable arm pivotally connected to the frame, the movable arm having a first end and a second end, at least one movable load unit supported by said movable arm and load transfer means configured to move said load unit along said movable arm.

BACKGROUND ART

Workout equipment comprising movable weight units, such as weight plates, are commonly used in weight exercising and training both in indoor and outdoor training facilities. In indoor training load adjustment of the workout equipment is typically achieved by loose, removable weight units. Problems relating to storing of loose weight units, maintenance issues and safety regulations, however, restrict the use of loose weight units in outdoor training equipment. Instead, in outdoor workout devices the load of the workout device is usually based on the body weight of the trainer, weight of the moving parts of the equipment and/or selection of the gripping position of the torque arm of the equipment. Load adjustment in the outdoor workout equipment is therefore usually inaccurate and complicated.

Document EP 3344348 B1 discloses an arrangement and a method for adjusting load in a training equipment especially suitable for outdoor use. The equipment comprises a moving arm pivotally connected to a frame, at least one load unit and an elongated guideway connected to the moving arm along which guideway the load unit is arranged to move. The arrangement further comprises a locking device for securing the load unit immovably to the guideway to a number of pre-determined locking positions. In EP 3344348 B1 accurate and stepless adjustment of the position of the weight unit is not possible.

Document EP 3434338 A1 discloses a sports training device for creating adjustable load. The device comprises a moving arm pivotally connected to a swinging axis and an U-shaped guide along which weight units can be moved. The weigh units are stacked on to the moving arm to two different distances from the swinging axis. Also in EP 3434338 A1 an accurate and stepless adjustment of the position of the weight units is not possible.

Document EP 1423170 B1 discloses a weight training apparatus with a load arm pivotably mounted on a frame, on which load arm a weight is mounted. The position of the weight is adjustable in the longitudinal direction of the load arm. The weight is located asymmetrically on the side of the load arm causing torsional stress to the load arm and to the weight transfer means.

An object of the invention is to provide a workout equipment for eliminating drawbacks relating to the prior art.

The object of the invention is achieved with a workout equipment.

SUMMARY OF THE INVENTION

The workout equipment according to the invention comprises a frame, a movable arm pivotally connected to the frame, the movable arm having a first end and a second end, at least one movable load unit supported by said movable arm and load transfer means configured to move said load unit along said movable arm. The movable arm includes a first guide and a second guide, the load unit is supported by said first and second guides and the load transfer means comprise a locking device for locking the load unit steplessly on the first and second guides. Stepless locking means here, that the load unit can be locked stationary on the first and second guides in any location where the movable load unit stands. The load transfer means comprise a threaded rod having a first end and a second end, which threaded rod is parallel to said first and second guides. Preferably, the threaded rod is located between said first and second guides. The load unit has a threaded aperture through which the threaded rod projects and the load unit comprises weight plates connected together, each weight plate having a hole creating said aperture. Rotating the threaded rod around its longitudinal axis forces the load unit to move along the first and second guides.

In a preferred embodiment of the workout equipment according to the invention said load transfer means comprise a rotator for rotating the threaded rod. Preferably said rotator is a wheel installed to the first end of the threaded rod.

In a second preferred embodiment of the workout equipment according to the invention said locking device is configured to prevent the rotation of the threaded rod. Preferably, the locking device is located in the first and/or second end of the threaded rod.

A yet another preferred embodiment of the workout equipment according to the invention further comprises a rear swing axle for providing a first pivotal connection to the frame, which rear swing axle is connected to the movable arm closer to the second end than to the first end of the movable arm. Preferably, said rear swing axle comprises a first rear shaft pin connected to the first guide and a second rear shaft pin connected to the second guide, which first and second rear shaft pins are aligned and between the first rear shaft pin and the second rear shaft pin there is a gap.

A yet another preferred embodiment of the workout equipment according to the invention further comprises a front swing axle for proving an alternative second pivotal connection to the frame, which front swing axle is connected to the movable arm closer to the first end than to the second end of the movable arm. Preferably, said front swing axle comprises a first front shaft pin connected to the first guide and a second front shaft pin connected to the second guide, which first and second front shaft pins are aligned and between the first front shaft pin and a second front shaft pin there is a gap.

A yet another preferred embodiment of the workout equipment according to the invention further comprises interchangeable handles detachably attached to or near to the first end of the movable arm.

A yet another preferred embodiment of the workout equipment according to the invention further comprises a casing enclosing said at least one movable load unit, said first and second guides and said threaded rod.

A yet another preferred embodiment of the workout equipment according to the invention further comprises a load indicator for expressing absolute or relative force or load needed to swing the movable arm. Said load indicator may comprise a window in the casing wall revealing the position of the at least one movable load unit inside the casing.

An advantage of the invention is, that the load unit can be locked to any desired position on the movable arm, whereby the workout load adjustment is stepless and accurate.

Another advantage of the invention is that the load adjustment is easy and fast to implement.

An advantage of a preferred embodiment of the invention is that the configuration of the equipment can be modified to create equipment suitable for different kinds of exercise and training.

BRIEF DESCRIPTION OF THE DRAWINGS

In the following the invention will be described in detail, by way of examples, with reference to the accompanying drawings in which.

DETAILED DESCRIPTION

Figure 1A:
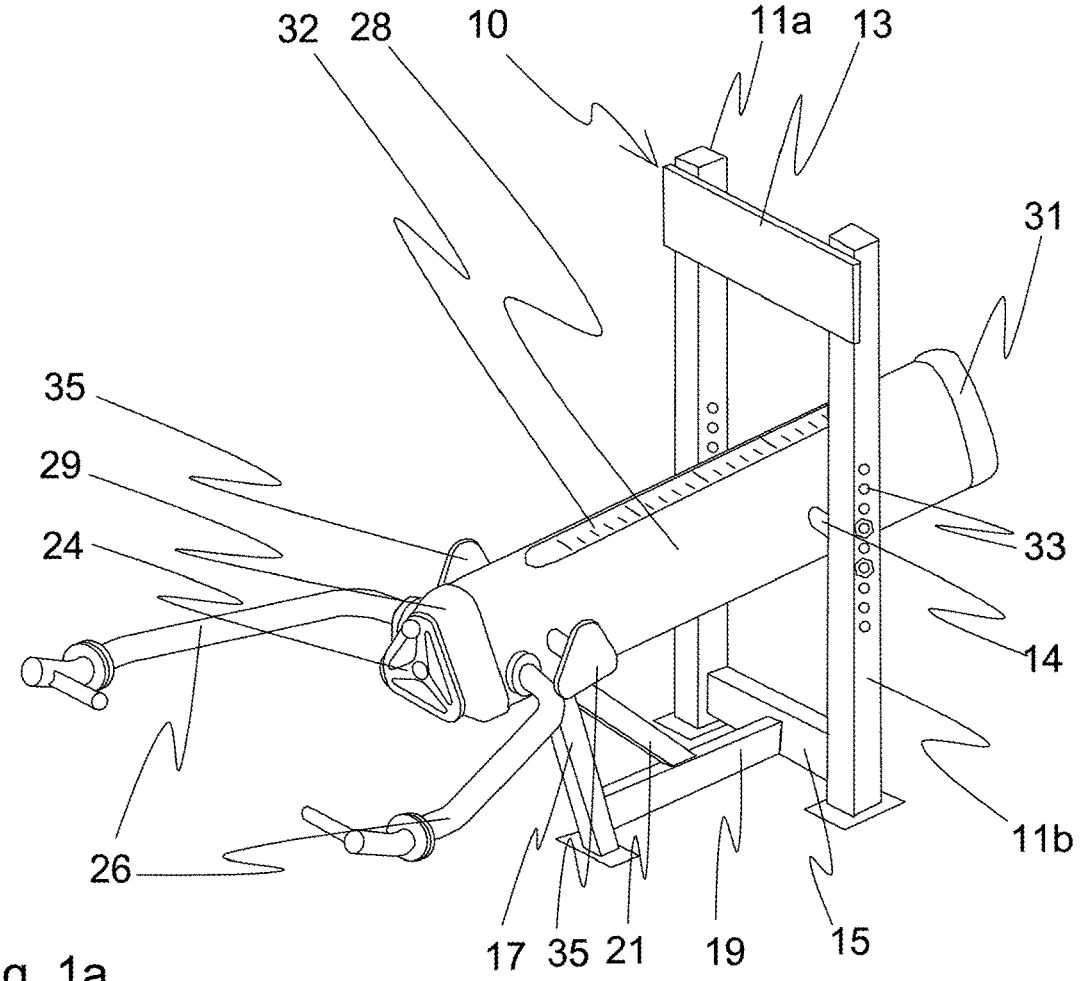
FIG. 1*a* depicts a workout equipment according to the invention seen oblique from above.

In FIG. 1*a* an example of a workout equipment according to the invention is shown oblique from above. The workout equipment includes a casing 28 enclosing a movable arm 12 (FIG. 2*a*) and a frame 10, to which the movable arm 12 is rotatably attached. The frame 10 has two parallel vertical support posts; a first support post 11*a* and a second support post 11*b*. The lower ends of the support post are designed to abut on the base on which the workout equipment stands. The frame 10 further comprises an upper plate 13 connecting the upper ends of the first and second support posts and a lower beam 15 connecting the lower ends of the first and second support posts. The movable arm 12 is connected to the support post via a rear swing axle 14, i.e. the rear part of the movable arm 12 is supported above the base by the support posts via the rear swing axle 14. The support posts are provided with a series of fixing holes 33 arranged in a row extending in a longitudinal direction of the support post. The movable axle can be supported to a desired elevation from the base by attaching the fixing bracket 42 (FIG. 2*a*) of the rear swing axle 14 to suitable fixing holes.

The front part of the movable arm 12 is supported by a lower stud 17. The lower stud is located below the movable arm 12 and the casing 28 in a slanted position the upper end of the stud abutting the movable arm 12 and the lower end of the stud abutting the base on which the workout equipment stands. In the upper end of the lower stud there is a support plate against which the front part of the movable arm 12 is arranged to settle. The opposite edges of the support plate are provided with holder plates 35. The lower stud is connected to the lower beam with a joint beam 19 and a corner joint of the joint beam and the lower stud is reinforced with a slanting support bracket 21 connecting the lower beam and the joint beam. The lower stud 17, joint beam 19 and the support bracket 21 are parts of the frame 10.

In the front end of the casing 28 these are two handles 26 for the use of the workout equipment. The handles 26 are attached from their first ends to the moving arm inside the casing and the second ends of the handles 26 are provided with hand grips. The handles 26 are removably connected to the moving arm, which makes possible to furnish the workout equipment with different kind of interchangeable handles 26. The handles 26 shown in FIG. 1*a* are designed to be used in workout or exercise in which the front end of the moving arm is lifted upwards from the position shown in FIG. 1*a*.

Further, in the front end of the casing 28 there is a front end plate 29 and a rotator 24 in form of a wheel for adjusting the load of the workout equipment in a manner explained later. At the rear end of the casing there is a rear end plate 31. In the uppermost edge part of the casing there is a longitudinal window 32, through which a load unit 16 locating inside the casing can be seen. The longitudinal edge of the window is provided with a scale indicating the exact location of the load unit 16 inside the casing.

FIG. 1*a* shows the workout equipment in a position where the movable arm 12 inside the casing is in a substantially horizontal position about one meter above the base on which the equipment stands. When the equipment is erected the movable axle can be supported to a suitable elevation from the base depending on the average height of the user group of the equipment. In this position the workout equipment is ready for use.

Figure 1B:
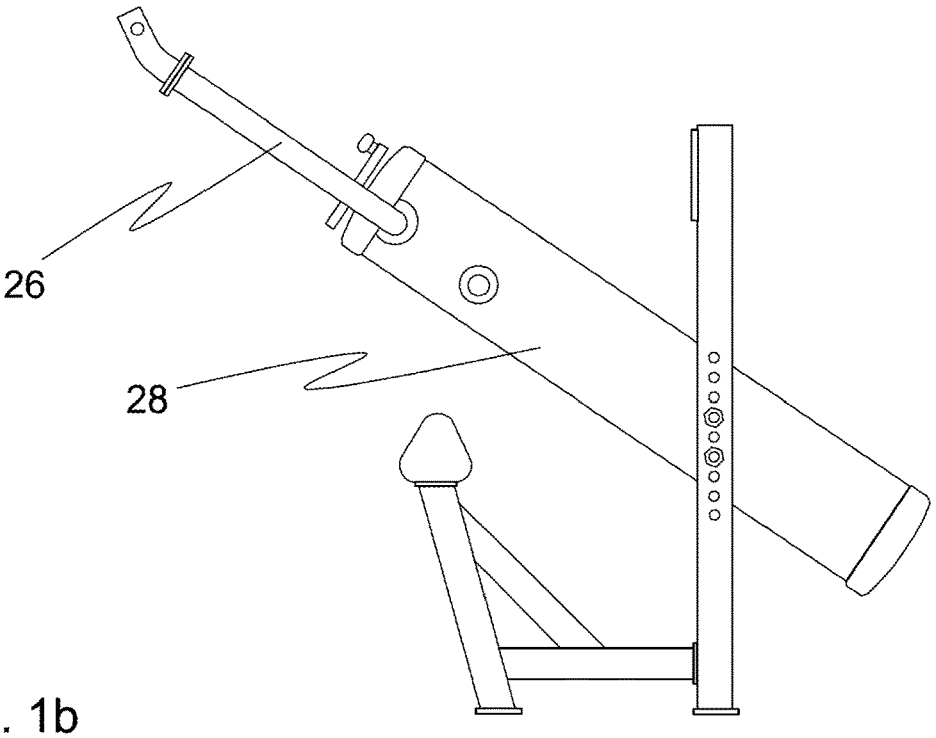
FIG. 1*b* depicts the workout equipment show in FIG. 1*a* as a side elevation.

In FIG. 1*b* the workout equipment shown in FIG. 1*a* is shown as a side elevation. In side elevation the handles 26 and the casing 28 are substantially parallel. FIG. 1*b* shows the equipment in a situation where the movable arm 12 inside the casing 28 is rotated around the rear swing axle 14 to an inclined position. Rotation of the movable arm 12 is achieved by lifting the front end of the movable arm 12 from the handles 26. The weight of the movable arm 12 and the movable load unit 16 carried by it constitute a workload, which the user of the equipment must lift to make the movable arm 12 rotate around the rear swing axle 14. When exercising with the equipment shown in FIGS. 1*a* and 1*b* the front end of the movable arm 12 is repeatedly lifted and lowered by the user of the equipment.

Figure 2A:
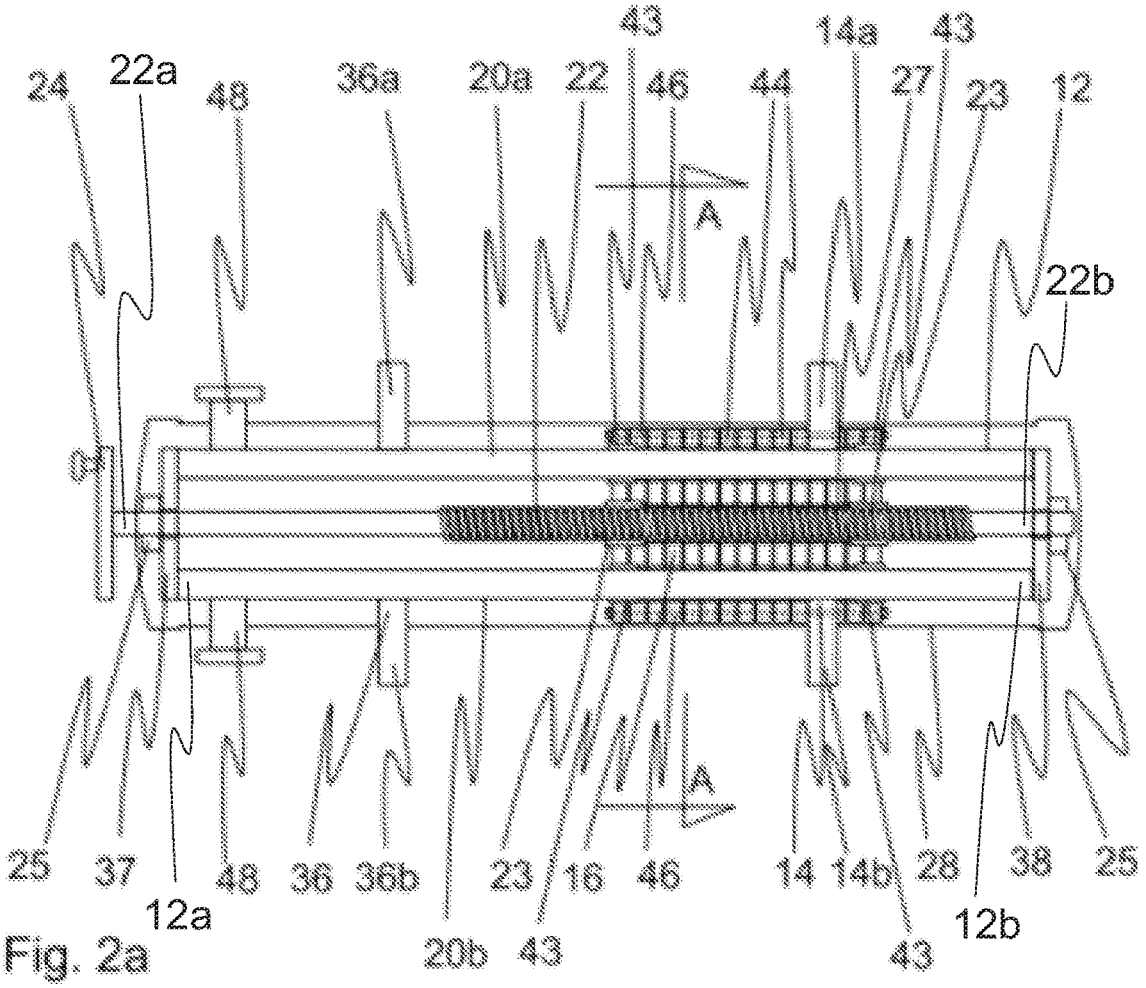
FIG. 2*a* depicts a part of the workout equipment according to the invention as a longitudinal cross-sectional view.
Figure 2B:
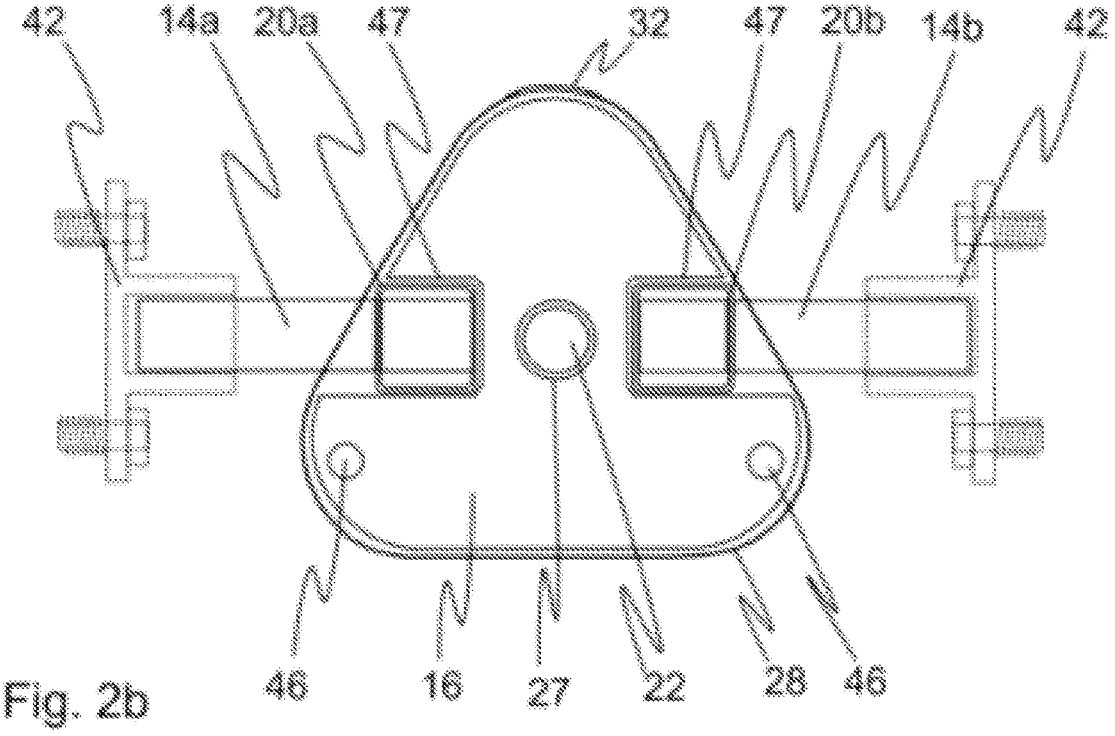
FIG. 2*b* depicts the part of the workout equipment according to the invention shown in FIG. 2*a* as a transverse cross-sectional view.

In FIG. 2*a* a part of the workout equipment according to the invention is shown as a longitudinal cross-sectional view and in FIG. 2*b* the same part is shown as a transverse cross-sectional view. In the following both figures are explained simultaneously.

FIGS. 2*a* and 2*b* display the movable arm 12 locating inside the casing 28. The movable arm 12 comprises two parallel guides; first guide 20*a* and a second guide 20*b*. The first and second guides 20*a*, 20*b* are apart, i.e. these are a gap between the guides. The first ends of the guides are attached to a first connecting plate 37 and the second ends of the guides are attached to a second connecting plate 38. Both connecting plates are inside the casing. Between the first and second guides 20*a*, 20*b* there is a threaded rod 22, which is parallel to the guides and lies in the same fictional plane with the guides. A first end 22*a* of the threaded rod 22 protrudes through a hole in the first connecting plate 37 and the second end 22*b* of the threaded rod 22 protrudes through a hole in the second connection plate 38. In a first end 22*a* of the threaded rod 22 there is the wheel acting as a rotator 24 of the rod. Both connecting plates are provided with locking devices 25, which surround the threaded rod 22 and which act as bearings when rotating force is exerted to the threaded rod 22. However, when no force is exerted to the threaded rod 22, locking devices 24 act as locking means preventing free rotation of the threaded rod 22.

A first rear shaft pin 14*a* is attached to the first guide 20*a* and a second rear shaft pin 14*b* is attached to the second guide 20*b*. The first and second rear shaft pins 14*a*, 14*b* are aligned and they lie in the same fictional plane with the first and second guides. The rear shaft pins do not extend into the gap between the first and second guides. The first and second rear shaft pins 14*a*, 14*b* together constitute the rear swing axle 14 locating closer to the second end 12*b* of the movable arm 12 than to the first end 12*a* of the movable arm 12.

In a similar manner a first front shaft pin 36*a* is attached to the first guide 20*a* and a second front shaft pin 36*b* is attached to the second guide 20*b*. The first and second front shaft pins 36*a*, 36*b* are aligned and they lie in the same fictional plane with the first and second guides. The front shaft pins 36*a*, 36*b* do not extend into the gap between the first and second guides. The first and second front shaft pins 36*a*, 36*b* together constitute a front swing axle 36, which locates closer to the first end 12*a* of the movable arm 12 than to the second end 12*b* of the movable arm 12.

The rear swing axle 14 and the front swing axle 36 provide two alternative fixing elements, with which the movable arm 12 can be connected to the frame 10. The free ends of the shaft pins extend outside the casing and the ends of the pins are rotatably attached to the support posts of the frame 10 with the aid of a fixing bracket 42. The fixing bracket has a tubular receiving portion into which the free end of the pin is inserted and a mounting plate, which can be attached to fixing holes of the support posts with bolts and nuts. The operation of the workout equipment depends on which axle is connected to the frame 10. In FIGS. 1*a* and 1*b* the movable arm 12 is pivotally connected to the frame 10 via the rear swing axle 14.

Further, a handle carrier 48 is attached to first guide 20*a* and to the second guide 20*b* near the first ends of the guides. The free ends of the handle carriers protruding outside the casing 28 are provided with fastening flanges, to which handles 26 (not shown) are secured.

Inside the casing there is a load unit 16 comprising a row of the weight plates 44, which are connected together to a single unit with connecting bars 46. The number of the weight plates 44 can be chosen in the assembly phase of the equipment. The weight plates 44 have a triangle resembling shape having straight sides connected by rounded corners. On the opposing sides of the weight plates 44 there are slots 47, which form a three-sided channel on the opposing sides of the load unit 16 extending through the whole load unit 16. The first guide 20*a* is placed into the first channel and the second guide 20*b* is placed into the second channel. The outer dimensions of the first and second guides 20*a*, 20*b* are slightly smaller than the dimensions of the channel leaving a play, i.e. a narrow gap, between the surface of the guides and the surface of the channel. In both ends of the channel there is a slide bearing 43, which enables sliding of the load unit 16 along the guides with minimum friction.

The rear and front shafts pins 14*a*, 14*b*, 36*a*, 36*b* are attached to those sides on the guides which are facing the open side of the channels. Further, the shaft pins do not protrude into the gap between the guides. Therefore, the rear and front shafts pins do not hinder the movement of the load unit 16 along the first and second guides.

In the middle of each weight plate there is a hole creating an aperture 27 through the whole load unit 16, through which aperture 27 the threaded rod 22 protrudes. In the opposing ends of the aperture 27 there are sleeves 23 fixedly connected to the load unit 16. The inner surfaces of the sleeves 23 have inner threads matching the threads of the threaded bar. Twisting the rotator 24, i.e. the wheel, in the first end 22*a* of the threaded rod 22 forces the load unit 16 to slide along the first and second guides. Depending on the rotation direction of the threaded rod 22, the load unit 16 moves either towards the first end 12*a* of the movable arm 12 or towards the second end 12*b* of the movable arm 12.

Figure 3A:
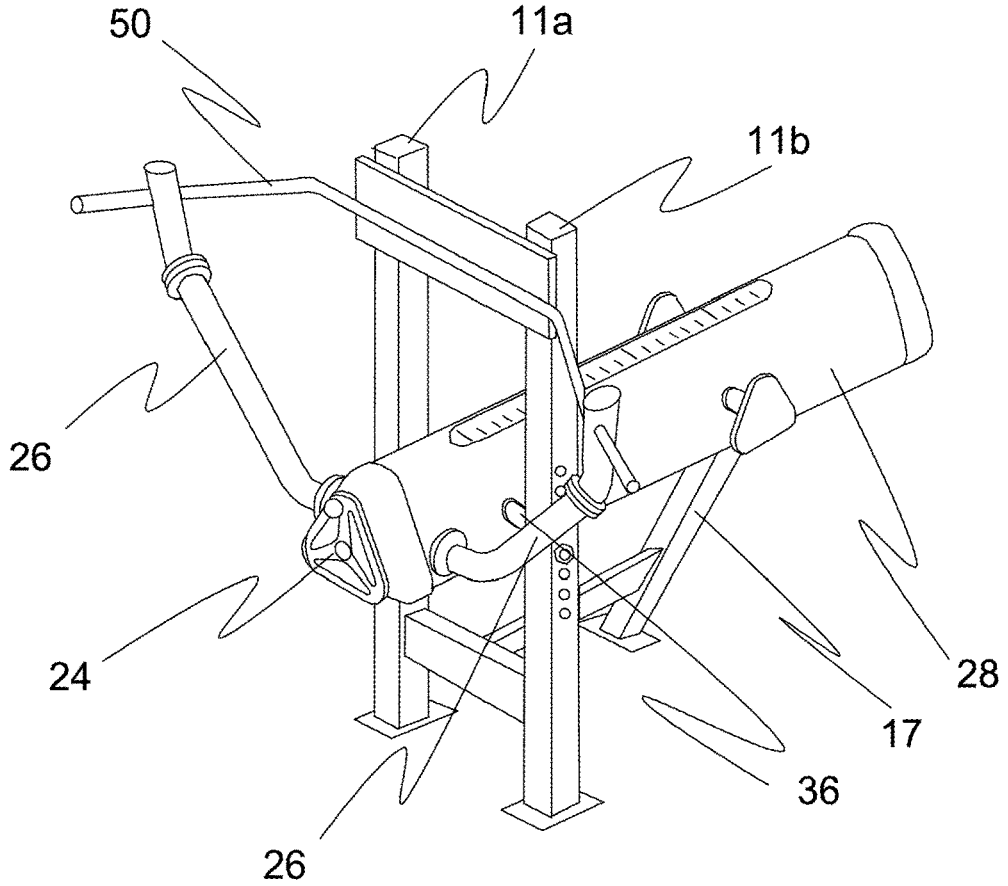
FIG. 3*a* depicts a preferred embodiment of the workout equipment according to the invention seen oblique from above and FIG. 3*b* depicts the embodiment shown in FIG. 1*a* as a side elevation.
Figure 3B:
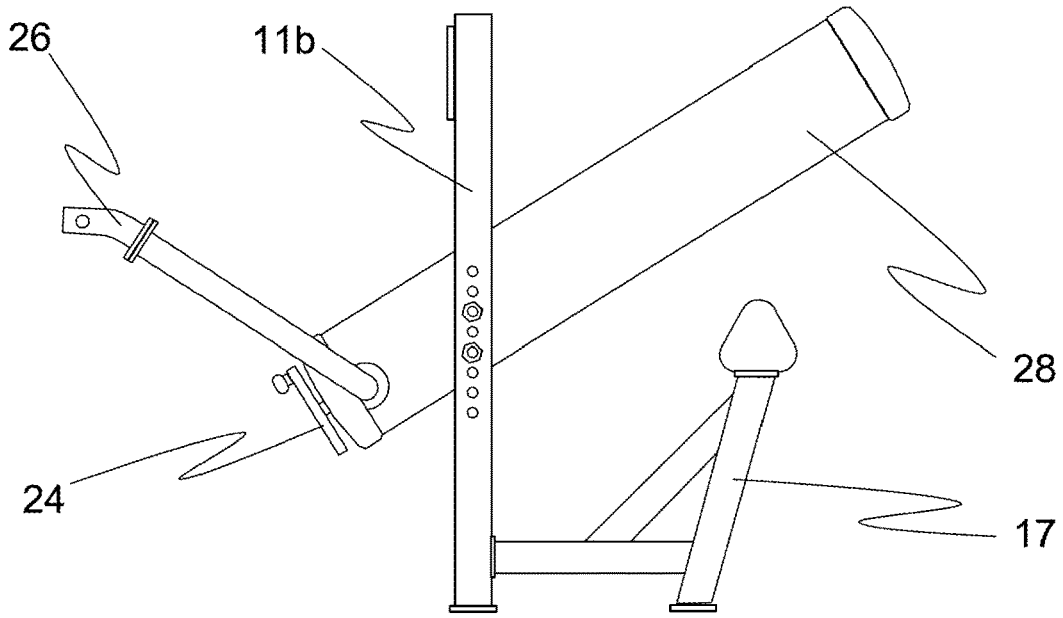

In FIG. 3*a* an example of a preferred embodiment of the workout equipment according to the invention is shown oblique from above and in FIG. 3*b* the embodiment of FIG. 3*a* is shown as a side elevation. In the following both figures are explained simultaneously.

The embodiment of the invention shown in FIGS. 3*a* and 3*b* contains the same features as the invention explained above. The embodiment differs from the invention explained in FIGS. 1*a* and 1*b* in that the movable arm 12 is supported to the first and second supports post 11*a*, 11*b* of the frame 10 via front swing axle 36. The frame 10 is also turned 180 degrees in relation to the movable arm 12 to a position, where the lower stud 17 is configured to support the rear end on the movable arm 12 inside the casing 28. Further, the handles 26 of the embodiment of FIGS. 3*a* and 3*b* are different than in the invention explained in FIGS. 1*a* and 1*b*. Here the handles 26 are in an upwards inclined position in relation to the longitudinal direction of the casing. The hand grips of the handles 26 are connected by a tackle bar 50 for providing alternative gripping positions for the user.

When the embodiment of the workout equipment is used for exercising the user grips of the hand grips or to the tackle bar and pulls the handles 26 downwards. Downwards acting force causes the movable arm 12 inside the casing to rotate around a front swing axle 36, whereby the rear end of the casing and the movable load unit 16 inside the casing raise upwards. During the workout the front end of the movable arm 12 is repeatedly pulled down and let to rise upwards. The user of the equipment may sit on a bench (not shown) in front of the equipment. The user may adjust the workout load suitable for himself by twisting the rotator 24.

The invention explained above is especially suitable for outdoor use. However, the invention is not limited for outdoor use only, but it can be used also in indoor training facilities.

Some preferred embodiments of workout equipment has been disclosed above. The invention is not limited to the solutions explained above, but the invention can be applied in different ways within the limits set by the patent claims.

| Reference Signs: | |
|---|---|
| 10 | frame |
| 11a | first support post |
| 11b | second support post |
| 12 | movable arm |
| 13 | upper plate |
| 14 | rear swing axle |
| 14a | first rear shaft pin |
| 14b | second rear shaft pin |
| 15 | lower beam |
| 16 | load unit |
| 17 | lower stud |
| 19 | joint beam |
| 20a | first guide |
| 20b | second guide |
| 22 | threaded rod |
| 23 | sleeve |
| 24 | rotator |
| 25 | locking device |
| 26 | handle |

-continued

| Reference Signs: | |
|---|---|
| 27 | aperture |
| 28 | casing |
| 29 | front end plate |
| 31 | rear end plate |
| 32 | window |
| 33 | fixing hole |
| 35 | holder plate |
| 36 | front swing axle |
| 36a | first front shaft pin |
| 36b | second front shat pin |
| 37 | first connecting plate |
| 38 | second connecting plate |
| 42 | fixing bracket |
| 43 | slide bearing |
| 44 | weight plate |
| 46 | connecting bar |
| 47 | slot |
| 48 | handle carrier |
| 50 | tackle bar |

The invention claimed is:

1. A workout equipment comprising:

a frame;

a movable arm pivotally connected to the frame, the movable arm having a first end, a second end, a first guide and a second guide;

at least one movable load unit supported by said first and second guides of said movable arm and load transfer means configured to move said load unit along said movable arm;

wherein said load transfer means comprise a locking device for locking the load unit steplessly on the first and second guides and a threaded rod having a first end and a second end, said threaded rod being parallel to said first and second guides and said load unit has a threaded aperture through which the threaded rod projects and said load unit comprises weight plates connected together, each weight plate having a hole creating said aperture;

wherein opposing sides of the weight plates include slots, the slots forming a three-sided first channel on a first side of the load unit and a three-sided second channel on an opposing second side of the load unit, the first and second channels extending entirely through the load unit, the first guide is placed into the first channel and the second guide is placed into the second channel, and wherein outer dimensions of the first and second guides are smaller than dimensions of the first and second channels;

a slide bearing at first and second ends of the first and second channels;

a rear swing axle providing a first pivotal connection to the frame, said rear swing axle being connected to the movable arm closer to the second end of the movable arm than to the first end of the movable arm;

wherein said rear swing axle comprises a first rear shaft pin directly connected to the first guide and a second rear shaft pin directly connected to the second guide, the first and second rear shaft pins being aligned, and having a gap between the first rear shaft pin and the second rear shaft pin.

2. The workout equipment according to claim 1, wherein said threaded rod is located between said first and second guides.

3. The workout equipment according to claim 1, wherein said load transfer means further comprise a rotator for rotating the threaded rod.

4. The workout equipment according to claim 3, wherein said rotator is a wheel installed to the first end of the threaded rod.

5. The workout equipment according to claim 1, wherein said locking device is configured to prevent rotation of the threaded rod.

6. The workout equipment according to claim 1, wherein said locking device is located in the first end and/or the second end of the threaded rod.

7. The workout equipment according to claim 1 further comprising interchangeable handles detachably attached to or proximate the first end of the movable arm.

8. The workout equipment according to claim 1 further comprising a casing enclosing said at least one movable load unit, said first and second guides and said threaded rod.

9. The workout equipment according to claim 1 further comprising a load indicator for expressing absolute or relative force or load needed to swing the movable arm.

10. The workout equipment according to claim 8, wherein said load indicator comprises a window in the casing wall revealing a position of the at least one movable load unit inside the casing.

* * * * *